United States Patent [19]

Minick

[11] Patent Number: 4,508,300

[45] Date of Patent: Apr. 2, 1985

[54] SUPPORT BRACKET FOR ACCESSORY BEAM

[75] Inventor: Harold N. Minick, Tryon, N.C.

[73] Assignee: Wolff Wire Corporation, Ludington, Mich.

[21] Appl. No.: 422,220

[22] Filed: Sep. 23, 1982

[51] Int. Cl.[3] ..... A47B 96/06

[52] U.S. Cl. ..... 248/216.1; 52/36; 248/231.4

[58] Field of Search ..... 248/216.1, 201, 231.4, 248/71, 217.3; 160/135; 52/36

[56] References Cited

U.S. PATENT DOCUMENTS

| | | | |
|---|---|---|---|
| Re. 28,408 | 5/1979 | Nelson | 52/36 |
| 964,376 | 7/1910 | Blackburn | 248/226.1 X |
| 1,156,998 | 10/1915 | Heberling | 248/201 X |
| 2,954,955 | 10/1960 | Feller | 248/226.1 |
| 3,790,117 | 2/1974 | Winkler | 248/226.1 X |
| 4,125,078 | 11/1978 | Nyquist | 248/201 X |
| 4,296,579 | 10/1981 | Proud | 52/36 X |
| 4,371,138 | 2/1983 | Roberts | 248/201 |
| 4,415,091 | 11/1983 | Wolff | 211/103 |

*Primary Examiner*—J. Franklin Foss
*Assistant Examiner*—David L. Talbott
*Attorney, Agent, or Firm*—Price, Heneveld, Huizenga & Cooper

[57] ABSTRACT

A means for mounting accessories to space divider panels includes brackets capable of supporting the accessory anchoring beams on panels having no conventional slotted standards. The means are brackets which seat around the edge of a panel and inner and outer members which when a fastener is tightened clamp the panel between them. The members are equipped with needle-like teeth which penetrate the panel and secure the bracket without marring the decorative fabric jacket of the panel.

2 Claims, 13 Drawing Figures

SUPPORT BRACKET FOR ACCESSORY BEAM

FIELD OF THE INVENTION

The invention relates to the mounting of accessories on space divider panels of the type used to form walls by joining various panels together in edge to edge relationship to form the so-called "landscape" type office partitioning.

BACKGROUND OF THE INVENTION

Panels of this type are used to provide separate work areas with some or all of the work facilities such as work surfaces, storage facilities and work organizing accessories mounted on the panels. The brackets are detachably secured to the panels by hooking them to rigid, slotted standards or strips provided along each vertical edge of the panel. The brackets mount a beam which extends across the face of the panel and the accessories, in turn, are mounted on the beam. Such an arrangement is described in co-pending application, Ser. No. 269,417, entitled "Accessories For Movable Partition Systems", filed June 1, 1981, and having a common assignee. This invention provides a means of securing accessories utilizing the same beam construction to panels which do not have the rigid attachment standards along each edge normally used to secure the accessory supporting brackets. The absence of the rigid edge supports creates a problem because the accessories should be capable of being mounted at various heights and of relocation from panel to panel without leaving a damage mark on the panel's surface. Also the accessories must be rigidly supported and the supports must be capable of withstanding substantial cantilevered loads.

BRIEF DESCRIPTION OF THE INVENTION

The invention provides a bracket capable of extending between a pair of the panels and of clamping to one of the panels to provide a rigid support for the accessory supporting beam. The bracket has sufficient vertical width that it will withstand the torsional evading created by the accessories without twisting and marring the panel. It also provides an anchor which is substantially concealed and, therefore, does not detract from the panel's appearance. The same fastener means which provides the clamping effect upon the panel also provides the clamping effect upon the accessory supporting beam, thus simplifying the installation.

DESCRIPTION OF THE PREFERRED EMBODIMENT

Figure 2:
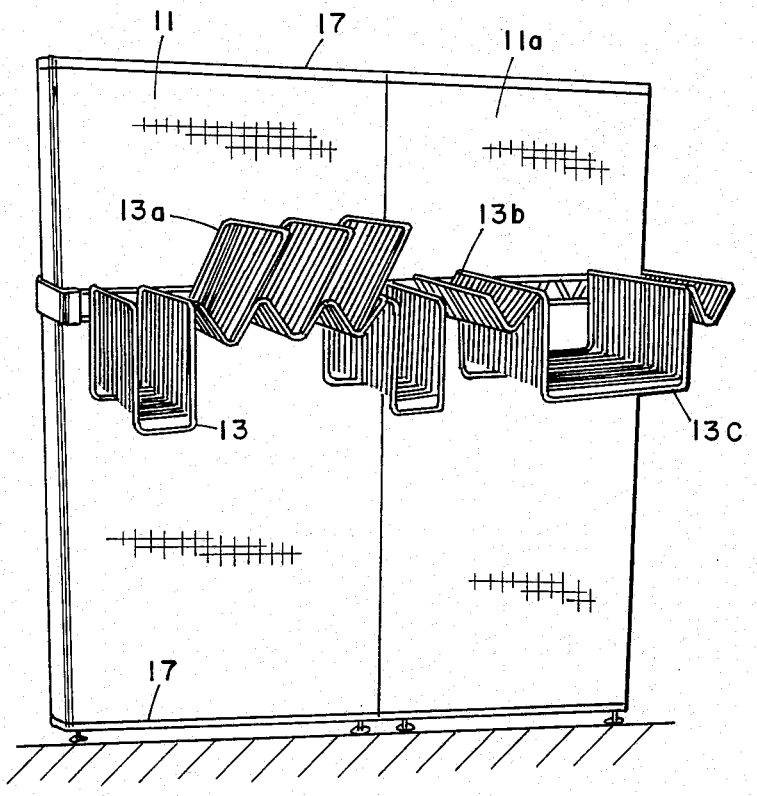
FIG. 2 is a view similar to FIG. 1 illustrating the beams with accessory units mounted on them.

The numeral 10 refers to a space divider, panel wall having a pair of panels 11 and 11*a* joined together in edge-to-edge relationship by any suitable manner, not illustrated inasmuch as the joinder means forms no part of the invention. Mounted across the front of the panels are a pair of beams 12, one on each of the panels. The beams are supported by anchor brackets 20 at the exposed edges of the panels and by an anchor bracket 21 where the two panels are joined with the bracket 21 being a support common to both of the beams 12. As illustrated in FIG. 2, it will be noted that the beams 12 are utilized to support various types of accessories such as various types of work holders and organizers 13, 13*a*, 13*b* and 13*c*. The specific construction of the beams 12 and of the accessories 13–13*c* and the manner in which they are secured to the beams 12 is disclosed in co-pending application Ser. No. 269,417, entitled "Accessories For Movable Partition Systems", filed June 1, 1981 and the subject matter of that application is hereby incorporated into this application by reference and made a part hereof.

Figure 1:
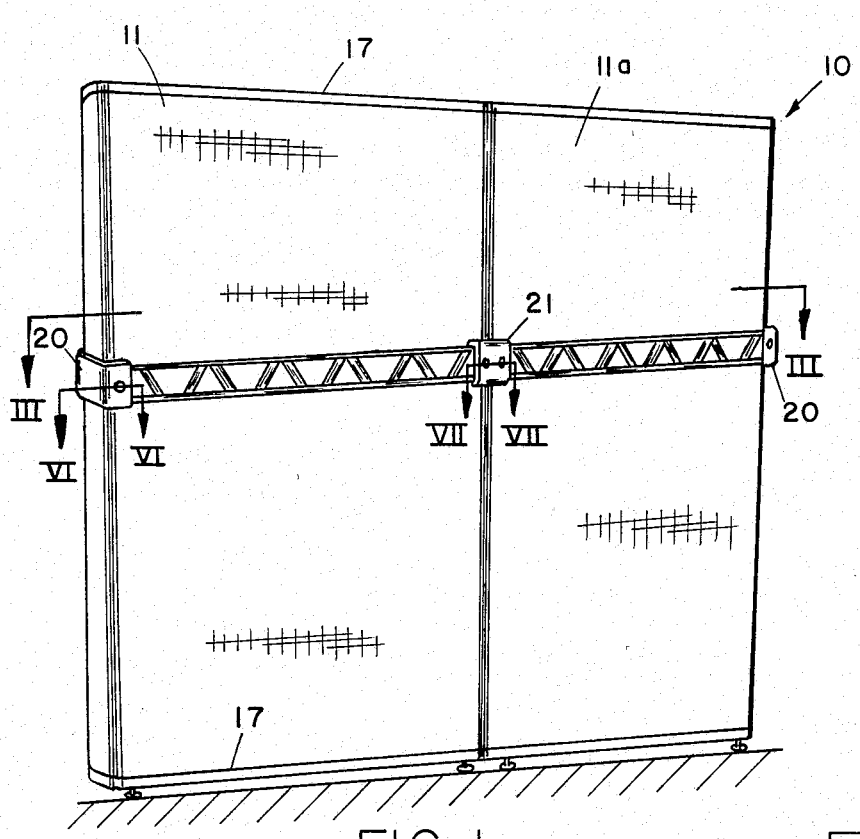
FIG. 1 is an oblique view of a pair of panels to which accessory supporting beams have been secured by means of this invention.
Figure 3:
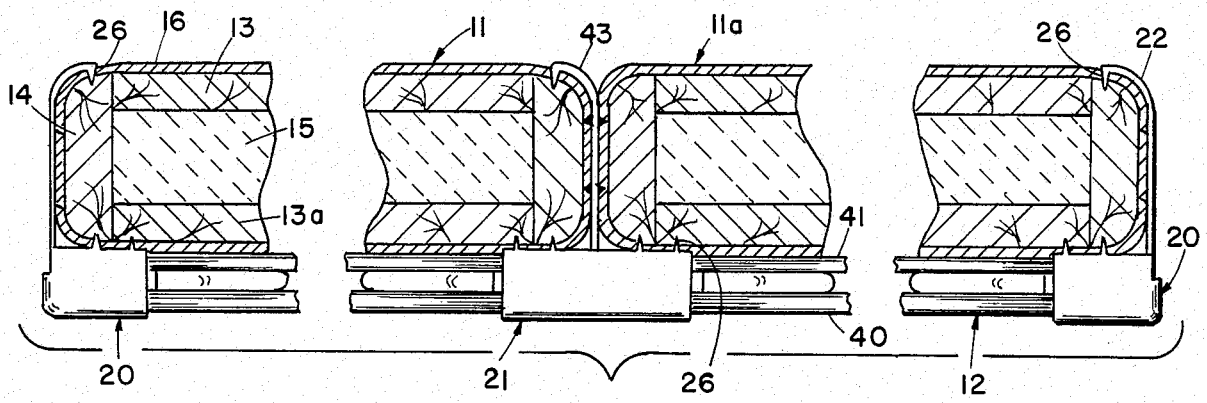
FIG. 3 is an enlarged, fragmentary view taken along the plane III—III of FIG. 1.
Figure 4:
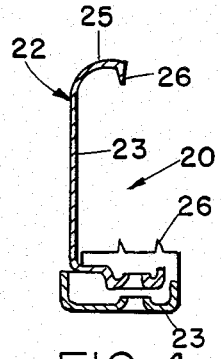
FIG. 4 is a central sectional view of one type of bracket incorporating this invention.
Figure 5:
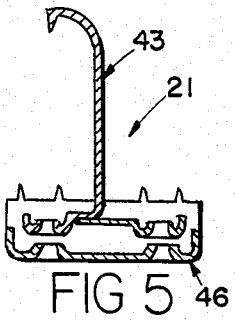
FIG. 5 is a central sectional view of a modified form of bracket incorporating this invention.
Figure 10:
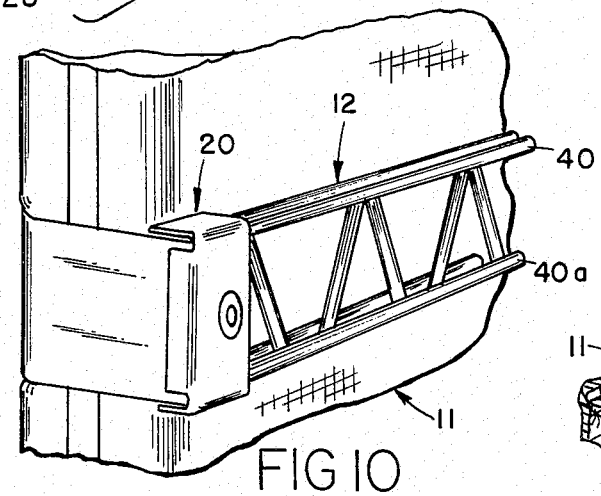
FIG. 10 is an enlarged, oblique view of the bracket illustrated in FIGS. 4 and 8 as it appears when installed.
Figure 11:
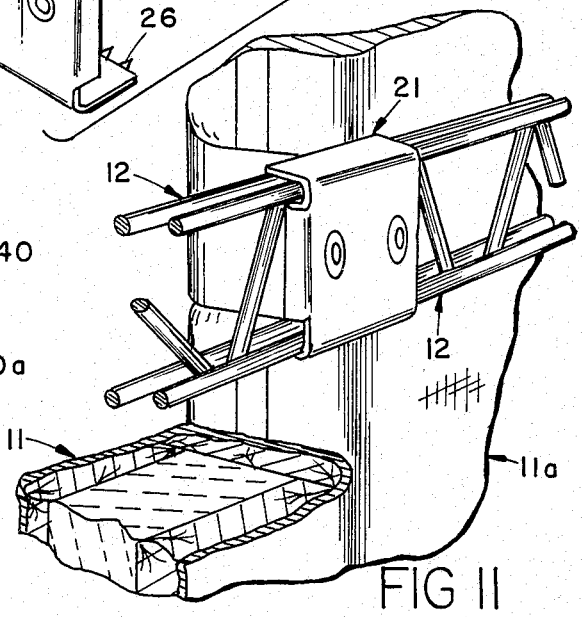
FIG. 11 is an enlarged, oblique view of the bracket illustrated in FIG. 9 as it appears when installed.

The panels with which this invention is concerned can be constructed in various ways. As best seen in FIG. 3, the body of the panel has a pair of facing sheets 13 and 13*a*, preferably of plywood, surrounded by a wooden frame 14 and spaced apart by a core 15 of a suitable material such as a rigid foam. Foam is a desirable core material because it reduces weight. The facing sheets 13 and 13*a* are bonded to both the core 15 and to the peripheral frame 14. The panel body provides the panel with strength and rigidity. The panel is encased in a decorative jacket 16 which preferably is fabric stretched and bonded over the entire surface of the panel including the front and back faces and the side edges. Preferably, the top and bottom of the panel are provided with dress strips 17 (FIGS. 1 and 2). It will be noted that the fabric extends from the faces around the corner edges of the panel and the fabric covering each face is seamed 18 at the center of the edges of the panel (FIGS. 10 and 11). Thus, there is no strip or standard provided for the mounting of accessories such as is commonly used on this type of space divider panel construction. The invention provides a means of overcoming this problem.

As best seen in FIGS. 4, 6, 8 and 10 the bracket 20 consists of an inner anchor member 22 and an outer anchor member 23. The inner anchor member 22 is shaped somewhat like a shallow U having a leg 24 designed to seat against the edge of a panel and extend from one face of the panel to the other. On its rearward end, the leg has a flange 25 which is bent at a right angle to extend against the back face of the panel. Extending inwardly from the edge of the flange 25 toward the center of the panel are a pair of teeth 26. The opposite or front end of the anchor member 22 has a flange 27 extending generally parallel to the flange 25 but spaced sufficiently from it that the panel may be seated between the two flanges with the flange 27 spaced a short distance outwardly from the front face of the panel.

The front or outer bracket 23 is shaped to form a cap portion 28 which seats over and, when installed, entirely covers the flange 27 of the inner bracket. It has a pair of lips 29 which, when the bracket is installed, extend horizontally and rearwardly toward the panel. These are at the upper and lower edges of the outer bracket. Extending from the inner edge of each of the lips 29 are two or more spaced teeth 26 identical to the teeth on the flange 25.

Figure 6:
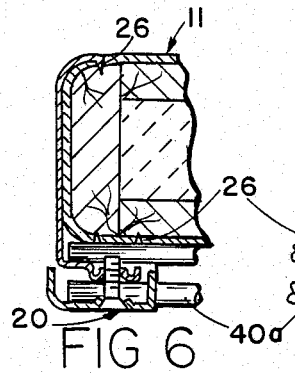
FIG. 6 is a fragmentary, enlarged sectional view taken along the plane VI—VI of FIG. 1.
Figure 7:
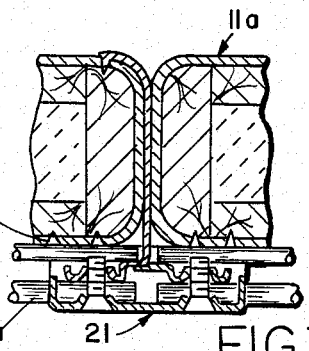
FIG. 7 is a fragmentary, enlarged sectional view taken along the plane VII—VII of FIG. 1.
Figure 8:
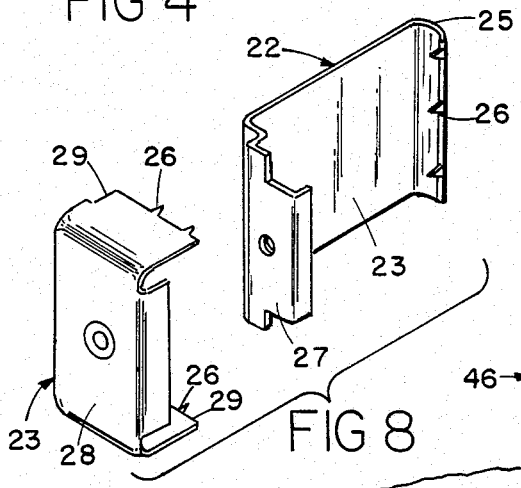
FIG. 8 is an exploded, oblique view of the bracket illustrated in FIG. 6.
Figure 9:
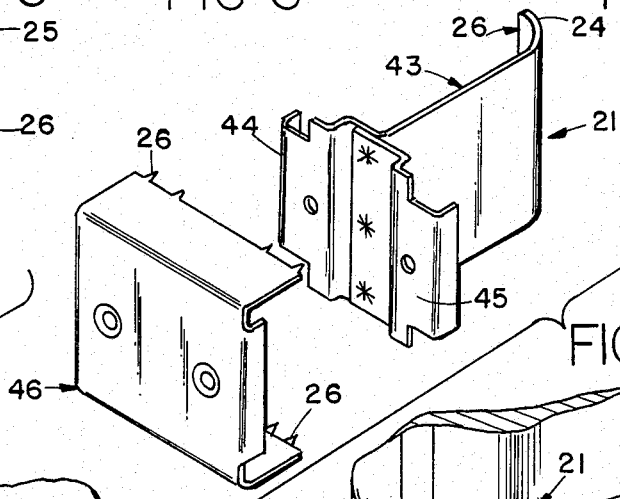
FIG. 9 is an exploded, oblique view of the bracket illustrated in FIG. 7.

As will be seen from FIG. 6, the outer rail 40 of one end of a beam 12 is seated between the inner and the outer anchor members. With the end of the beam so seated, a screw 31 is installed which pulls the inner anchor member 22 toward the outer anchor member 23 clamping the outer upper and lower rails 40 and **40*a* of the beam between the inner and outer brackets (FIGS. 6 and 10). At the same time, this causes the teeth 26 on the lip 29 of the outer bracket and the teeth 26 on the flange 25 of the inner bracket to lock to the panel by passing through the fabric jacket and penetrating the wooden substructure of the panel. The length of the lips 29 is such that their inner ends are seated against the panel face and the teeth 26 fully embedded in the panel before the inner rails 41 and the beam 12 make contact with the panel's surface. Thus, the bracket is firmly and positively locked to the panel with the beam tightly clamped between the inner and outer brackets. The clamping action on the outer rails is sufficient to adequately support the beam and the attachment of the anchor member to the panel is entirely dependent upon the clamping action between the lips 29 and the flange 25**.

Where the invention is to be used between two abutting panels to support a beam 12 on each panel, an anchor member 21 is used. This anchor member is similar to anchor member 20 except the inner one of the anchor members 43 is modified to be generally J-shaped having a head portion 44 extending laterally on both sides of the legs 23 to overlie both panels (FIGS. 7, 9 and 11). This can be done be securing an extension member 45 to the inner anchor member 22 by suitable means such as spot welding (FIG. 9). The outer anchor member 46 is similar in construction to the outer anchor member 23 except that it is elongated to cover the entire head portion 44 of the inner anchor member 43. It is provided with two pairs of teeth 30 spaced such that both of the panels are penetrated by the teeth and two of the fasteners 31 are provided to provide even clamping pressure against both panels.

Figure 12:
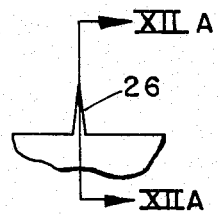
FIGS. 12 and 12A are enlarged, fragmentary front and side views, respectively, of one of the teeth with which the bracket is equipped.
Figure 12A:
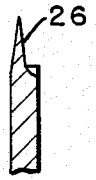

The teeth 26 are formed to be slender and, thus, needle-like. This is important because it is important that they be able to pass through the fabric jacket 16 of the panels without cutting or distorting the fabric. Yet they must be long enough to penetrate and positively anchor to the wooden core of the panels. The needle-like shape of the teeth 26 is illustrated in FIGS. 12 and 12A. Such teeth can be formed by striking the edge of the anchor members with a suitable upset die.

It will be observed from FIGS. 8 through 11 that the inner anchor members 22 and 44 are of substantial vertical width. This is necessary to provide adequate spacing, not only to receive the beam within the cap portion of the outer anchor member, but also to provide sufficient spacing between the teeth 26 at the end of the flange 25 and sufficient area in bearing between the flange 25 and the back face of the panel to withstand the torsional loading imposed upon the beam by the accessories 13 without twisting and without ripping or tearing of the fabric jacket 16 of the panel. It is important that this same vertical bearing be provided at both the back and the front of the panel to provide this type of support. This is particularly important in view of the fact that the anchor members are particularly intended to be capable of being moved from one position on the panels to another without leaving a damage mark on the panel in the area from which removed. This is essential to this type of landscape, space divider equipment because it is its characteristic flexibility which permits the panels to be repeatedly rearranged and thus the accessories to be rearranged also that so favorably affects the acceptability of this type of space divider system. Thus the anchor members must be capable of being relocated without damage to the areas where they were previously secured.

It will be seen that this invention for the first time provides an effective means of securing accessories to modular panelling units which have no accessible mounting means with the added feature that the accessories can be mounted at any vertical position along the height of the panel and can be shifted from one panel or one location to another without leaving a detectable damage mark in the areas from which removed.

Having described a preferred embodiment of this invention, it will be recognized that various modifications of the invention can be made without departing from the principles thereof. Such modifications are to be considered as included in the hereinafter appended claims unless these claims by their language expressly state otherwise.

The embodiments of the invention in which an exclusive property or privilege is claimed are defined as follows:

1. An accessory support bracket and accessory mounting beam for use on movable panel walls consisting of panels joined together in edge-to-edge relationship, said panels having a rigid penetratable core member covered on each face with decorative fabric, said bracket characterized in that it has inner and outer anchor members, said inner anchor member having a leg to seat against an edge of a panel, a vertically elongated first flange on one end extending normal to the plane of said leg and adapted to seat against the inner face of the panel; needle-like teeth on the end of said first flange for penetrating the inner face of the panel; a second flange forming a head portion on the outer end of said inner anchor member, said outer anchor member including a cap portion seated over the head portion of said inner anchor member and said cap portion having a pair of parallel flanges extending in the same direction as said leg; needle-like teeth on the inner ends of said flanges directed toward said teeth on said inner bracket for penetrating and gripping the panel; a portion of an accessory mounting beam being seated between said inner and outer anchor members; a fastener connecting said inner and outer anchor members for drawing them together to clamp both said panel and said beam between them.

2. An accessory support as described in claim 1 further characterized in that said head portion of said inner anchor member extends in both directions from the plane of the leg portion to seat against a pair of abutting panels; a pair of accessory anchoring beams are provided, the ends of said beams being received and clamped between said head portion and said cap on opposite sides of said leg.

* * * * *